US005468125A

United States Patent [19]

Okpara et al.

[11] Patent Number: 5,468,125

[45] Date of Patent: Nov. 21, 1995

[54] TURBINE BLADE WITH IMPROVED HEAT TRANSFER SURFACE

[75] Inventors: Nnawuihe Okpara, Peoria; Chester L. Henry, Tempe, both of Ariz.

[73] Assignee: AlliedSignal Inc., Morris Township, N.J.

[21] Appl. No.: 359,504

[22] Filed: Dec. 20, 1994

[51] Int. Cl.[6] ..... F01D 5/18

[52] U.S. Cl. ..... 416/97 R; 415/115

[58] Field of Search ..... 416/96 R, 96 A, 416/97 R; 415/115, 178

[56] References Cited

U.S. PATENT DOCUMENTS

| | | | |
|---|---|---|---|
| 3,171,631 | 3/1965 | Aspinwall . | |
| 3,574,481 | 4/1971 | Pyne, Jr. et al. . | |
| 3,628,880 | 12/1971 | Smuland et al. . | |
| 3,806,276 | 4/1974 | Aspinwall . | |
| 3,950,113 | 4/1976 | Albrecht . | |
| 4,019,831 | 4/1977 | Franklin et al. . | |
| 4,515,523 | 5/1985 | North et al. . | |
| 4,515,526 | 5/1985 | Levengood | 416/97 R |
| 4,565,490 | 1/1986 | Rice . | |
| 4,786,233 | 11/1988 | Shizuya et al. | 416/97 R |
| 5,232,343 | 8/1993 | Butts | 416/97 R |
| 5,288,207 | 2/1994 | Linask | 416/97 R |

FOREIGN PATENT DOCUMENTS

| | | | |
|---|---|---|---|
| 182304 | 9/1985 | Japan | 416/97 R |
| 187501 | 8/1986 | Japan | 416/97 R |
| 2112467 | 7/1983 | United Kingdom | 416/97 R |

*Primary Examiner*—Edward K. Look
*Assistant Examiner*—James A. Larson
*Attorney, Agent, or Firm*—James W. McFarland

[57] ABSTRACT

A turbine blade such as a rotor blade or stator vane in a gas turbine engine is provided of the type having an internal flow path for flow-through passage of a cooling gas stream, wherein the turbine blade includes a heat transfer surface designed for improved heat transfer with the cooling gas. The heat transfer surface comprises a regular pattern of turbulator vanes which extend generally transversely to the flow direction of the cooling gas stream, in combination with comparatively shorter heat transfer ribs which extend generally parallel to the gas stream flow direction. The pattern of turbulator vanes and heat transfer ribs provides significantly improved heat transfer between the turbine blade and the cooling gas stream, such that the cooling flow requirement is reduced to result in increased engine efficiency.

11 Claims, 1 Drawing Sheet

TURBINE BLADE WITH IMPROVED HEAT TRANSFER SURFACE

BACKGROUND OF THE INVENTION

This invention relates generally to improvements in turbine blades such as a stator vane or rotor blade in a gas turbine engine. More specifically, this invention relates to an improved turbine blade of the internally cooled type, wherein the turbine blade is formed to define a heat transfer surface designed for improved heat transfer with a cooling gas stream.

Internally cooled turbine blades in a gas turbine engine are generally known in the art. Such turbine blades, including fixed stator vanes and moving rotor blades, are formed to include an internal flow path for flow-through passage of a cooling gas stream to prevent overheating of blade surfaces. In a typical design, the cooling gas stream comprises a compressed air bleed flow from an engine compressor or compressor stage. In this regard, it is desirable to minimize the cooling flow requirements for regulating blade temperature, so that a maximum compressor discharge flow is available for supply to the engine combustor resulting in maximized overall engine efficiency.

In the past, internally cooled turbine vanes have been designed with a variety of different surface geometries intended to improve heat transfer between the turbine blade and the cooling gas stream, in efforts to reduce blade cooling flow requirements. In some of these designs, improved heat transfer has been achieved with specific surface geometries for increasing the turbulence of the cooling gas stream as it passes through the internal blade flow path.

There exists, however, a significant need for further improvements in internally cooled turbine blades, particularly with respect to increasing heat transfer between the blade and a cooling gas stream. The present invention provides an improved heat transfer surface on the blade for achieving this objective.

SUMMARY OF THE INVENTION

In accordance with the invention, an internally cooled turbine blade includes an improved heat transfer surface for substantially improving heat transfer between the turbine blade and a cooling gas stream. The heat transfer surface comprises a regular pattern of turbulator vanes extending generally transversely to the flow direction of the cooling gas stream, in combination with comparatively shorter heat transfer ribs disposed between adjacent pairs of the turbulator vanes and oriented to extend generally parallel to the gas stream flow direction. The heat transfer surface, comprising the pattern of turbulator vanes and heat transfer ribs, provides for substantially improved heat exchange between the turbine blade and the gas stream, such that total cooling flow requirements are significantly reduced.

In the preferred form, the turbine blade comprises an internally cooled stator vane or rotor blade for a gas turbine engine. The turbine blade has a generally hollow construction defining an internal flow path for flow-through passage of the cooling gas stream. In this regard, the cooling gas stream typically comprises a compressor bleed flow from a compressor or compressor stage of the gas turbine engine.

The improved heat transfer surface is formed on the turbine blade to define one wall of the internal flow path. In a preferred form, the blade is defined by assembled blade half-segments each having an appropriately contoured external surface and an internal surface formed according to the present invention. When the blade half-segments are assembled, the two half-segments cooperatively form the internal flow path, the opposite walls of which are defined by the heat transfer surfaces of the invention. Each such heat transfer surface is defined by the turbulator vanes which protrude a short distance into the flow path with an orientation to extend generally transversely of the gas stream flow direction. Alternately the turbulator vanes may be angled at between approximately 20° and 90° to the flow direction. The turbulator vanes function to trip or disrupt the gas stream boundary layer as the gas stream flows through the internal blade flow path. The heat transfer ribs, which in the preferred form have a generally triangular cross sectional or sinusoidal shape, are positioned in sets between the turbulator vanes to extend generally in parallel with the flow stream direction, to provide a substantially increased total surface area between the turbulator vanes. This increased total surface area has been found to provide a significant improvement in heat transfer between the cooling gas stream and the turbine blade.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
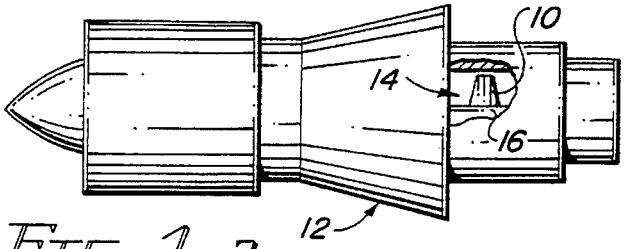
FIG. 1 illustrates a gas turbine engine having an improved turbine blade formed in accordance with the novel features of the invention.

As shown in the exemplary drawings, a turbine blade referred to generally in FIG. 1 by the reference numeral 10 is mounted within a gas turbine engine 12 along a hot gas carrying passage 14. The turbine blade 10 is shown in the form of a rotor blade which extends generally radially from a rotor hub 16 of a turbine wheel within the engine. In accordance with the invention, the turbine blade 10 has one or more internal flow paths 18 ( FIG. 2) for flow-through passage of a cooling gas stream, wherein the flow path is defined in part by an improved heat transfer surface 20 designed for improved heat exchange between the turbine blade 10 and the cooling gas stream.

The heat transfer surface 20 of the turbine blade 10 is specially designed to enhance the turbulent flow characteristics of the cooling gas stream flowing through the internal blade flow path or paths 18. With such enhanced turbulation, the transfer of heat from the turbine blade 10 to the cooling gas stream is significantly increased, whereby the volumetric gas stream flow can be significantly decreased yet still provide adequate turbine blade cooling. In this regard, the cooling gas stream is normally obtained as bleed flow from another portion of the engine, such as a compressor or compressor stage utilized primarily to deliver a high mass flow of air to an engine combustor. By decreasing the volumetric flow requirements of the cooling gas stream for cooling a plurality of internally cooled turbine blades, a proportionately greater air flow is available for passage to the engine combustor, resulting in improvements in combustor operation and overall turbine efficiency.

Figure 2:
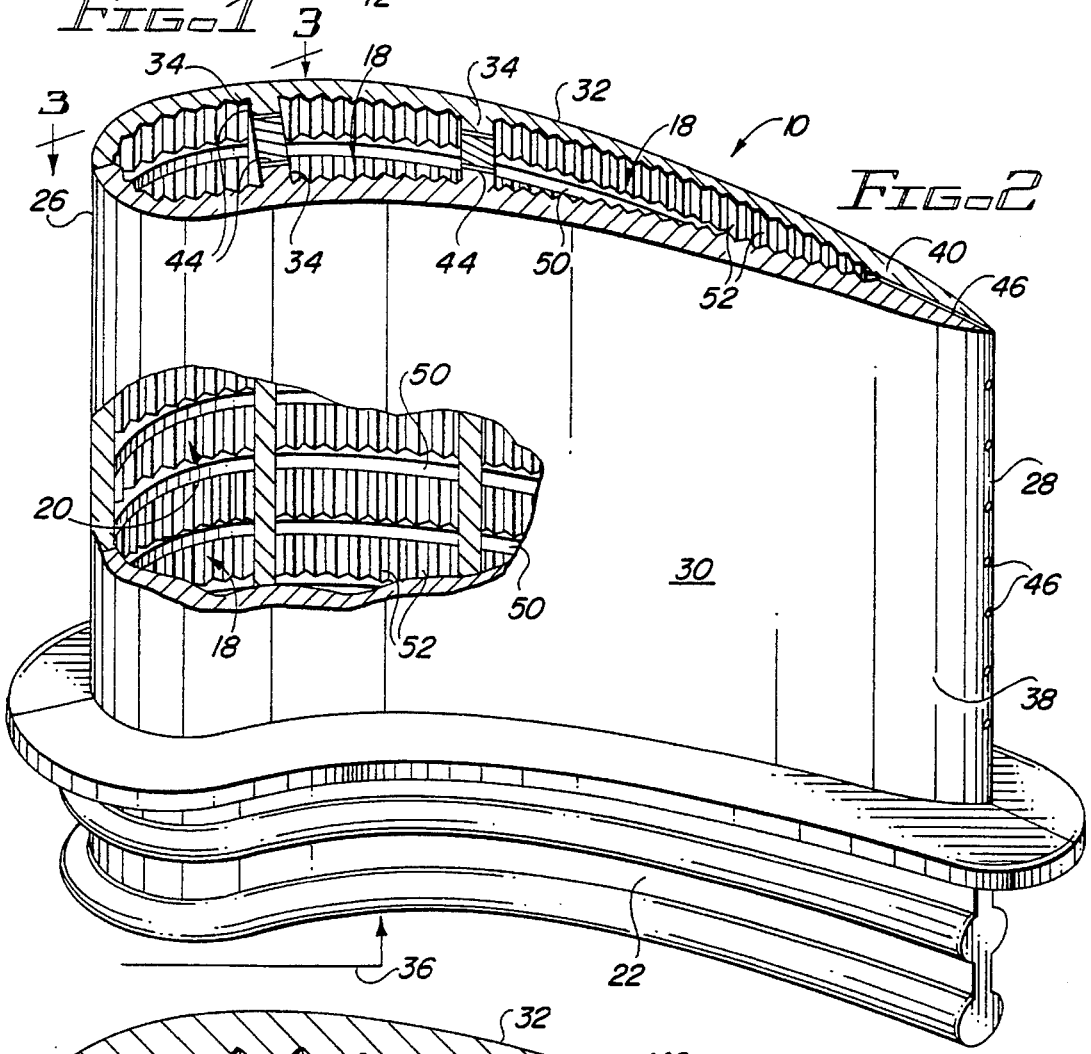
FIG. 2 is an enlarged and fragmented perspective view of the turbine blade shown in FIG. 1.

As shown best in FIG. 2, the exemplary turbine blade 10 extends generally radially outwardly from a root portion 22 having a dovetail or similar shape for secure mounting onto the engine hub 16 in a manner known to persons skilled in the art. The aerodynamic blade 10 projects radially outwardly from the root portion 22. As shown in FIG. 2, the blade 10 has a cross sectional shape which is typically arcuately curved in a cord-wise direction from a leading edge 26 to a trailing edge 28, and defines a pressure side 30 and a suction side 32.

The illustrative turbine blade 10 has a generally hollowed interior with internal partitions 34 which subdivide the blade interior into a plurality of generally longitudinally extending chambers or flow paths 18. As is known in the art, the cooling gas flow stream referenced in FIG. 2 by arrow 36 is delivered to these flow paths 18 for flow-through passage in heat transfer relation with the internal surfaces of the turbine blade. In one common and presently preferred form, the turbine blade 10 is constructed from matingly shaped blade half-segments 38 and 40 formed by casting and/or machining processes from a selected typical gas turbine blade superalloy. Importantly, while a turbine rotor blade is shown in the illustrative drawings in accordance with one preferred form of the invention, it will be understood that the invention is applicable to other internally cooled turbine engine blades, such as a stator vane or the like.

The cooling gas flow stream is delivered via the root portion 22 to the blade flow paths 18 for series and/or parallel flow therethrough. Flow ports 44 are formed in the various partitions 34 at appropriate locations to facilitate gas flow through the various chambers 18 for cooling purposes in combination with a general flow from the leading edge 26 to the trailing edge 28 whereat the gas flow is discharged via exit ports 46 to the hot gas passage 14.

Figure 3:
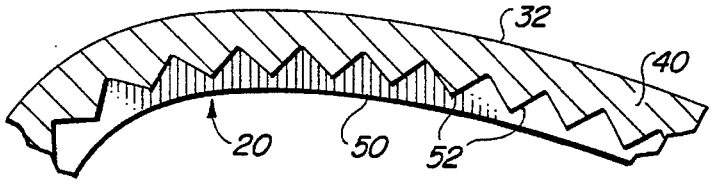
FIG. 3 is a further enlarged and fragmented sectional view taken generally on the line 3—3 of FIG. 2.

As shown in FIGS. 2 and 3, the improved heat transfer surface 20 defines at least one wall surface lining each flow path 18 for improved heat transfer between the metal surfaces of the blade 10 and the cooling gas stream. The heat transfer surface 20 comprises a regular or repeating pattern of turbulator vanes 50 which protrude a short distance into the associated chamber 18, extending generally parallel to each other and generally transversely to the flow direction of the cooling gas stream. Alternately the turbulator vanes may be angled at between approximately 20° and 90° to the flow direction. These turbulator vanes 50 have a sufficient height to protrude part-way into the flow path 18 to disrupt or trip the flow boundary layer, resulting in substantial gas flow turbulence. The turbulator vanes 50 are disposed along the flow path at regularly spaced intervals, in combination with sets of heat transfer ribs 52 disposed between each adjacent pair of the turbulator vanes 50. The heat transfer ribs 52 (FIG. 3) extend generally parallel to the direction of flow of the cooling gas stream, and define an extended heat transfer surface area for substantially improved heat transfer between the turbine blade and the gas flow stream.

Figure 4:
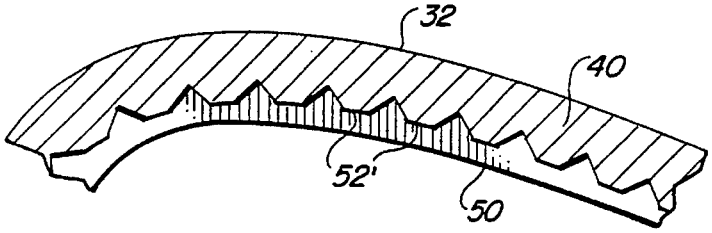
FIG. 4 is a fragmented sectional view similar to FIG. 3, but depicting one alternative preferred form of the invention.

FIGS. 2 and 3 show the heat transfer ribs 52 as protruding into the gas flow stream with a height which is approximately one-half the height of the associated turbulator vanes 50. In addition, FIGS. 2 and 3 show the illustrative ribs 52 with a generally triangular cross sectional shape, although it will be understood that other ribbed or similar shapes protruding into the gas flow stream may be used. For example, FIG. 4 shows modified heat transfer ribs 52' having a generally triangular cross sectional shape with flattened or truncated tips. In a preferred design, the heat transfer ribs have a height approximately one-half the height of the turbulator vanes, and the longitudinal spacing between adjacent tubulator vanes is approximately ten times the height, of the heat transfer ribs 52.

With the improved heat transfer surface 20 formed on both blade half-segments 38 and 40, each flow path 18 is thus defined on opposite sides by a pair of the surfaces 20. When employed in this manner, substantially improved heat transfer between the blade 10 and cooling gas stream has been demonstrated. In a typical gas turbine engine application, the heat transfer surface 20 has permitted the volumetric flow of the cooling gas stream to be reduced by as much as forty percent, thereby permitting a substantial portion of the cooling gas flow requirement to be diverted for supply to the engine combustor, with resultant improvements in overall engine operating efficiency.

A variety of further modifications and improvements to the improved turbine blade of the present invention will be apparent to those skilled in the art. Accordingly, no limitation on the invention is intended by way of the foregoing description, except as set forth in the appended claims.

What is claimed is:

1. In a turbo machinery blade having an internal flow path formed therein for flow-through passage of a cooling gas stream, the improvement comprising:

a heat transfer surface formed on said blade in a position lining at least a portion of said flow path;

said heat transfer surface including a plurality of turbulator vanes having a height to protrude partially into the flow path to disrupt flow of the cooling gas stream;

said heat transfer surface further including a plurality of heat transfer ribs formed in sets disposed between adjacent pairs of said turbulator vanes and extending generally parallel to the direction of flow of the cooling gas stream through said flow path, said heat transfer ribs protruding partially into the flow path with a height substantially less than the height of said turbulator vanes.

2. The improvement of claim 1 wherein said heat transfer ribs have a height approximately one-half the height of said turbulator vanes.

3. The improvement of claim 1 wherein said sets of heat transfer ribs define an extended surface area between each adjacent pair of said turbulator vanes.

4. The improvement of claim 1 wherein said turbulator vanes are longitudinally spaced along said flow path by a distance approximately ten times the height of said heat transfer ribs.

5. An internally cooled turbine blade, comprising:

an aerodynamically contoured blade portion having a generally hollow construction defining an internal flow path for flow-through passage of a cooling gas stream; and a heat transfer surface formed on said blade portion in a position lining at least a portion of said flow path;

said heat transfer surface including a plurality of turbulator vanes having a height to protrude partially into the flow path to disrupt flow of the cooling gas stream;

said heat transfer surface further including a plurality of heat transfer ribs formed in sets disposed between adjacent pairs of said turbulator vanes and extending generally parallel to the direction of flow of the cooling gas stream through said flow path, said heat transfer ribs protruding partially into the flow path with a height substantially less than the height of said turbulator vanes.

6. The turbine blade of claim 5 wherein said heat transfer ribs have a height approximately one-half the height of said turbulator vanes.

7. The turbine blade of claim 5 wherein said sets of heat transfer ribs define an extended surface area between each adjacent pair of said turbulator vanes.

8. The turbine blade of claim 5 wherein said turbulator vanes are longitudinally spaced along said flow path by a distance approximately ten times the height of said heat transfer ribs.

9. The turbine blade of claim 5 wherein said blade portion comprises a pair of matingly shaped blade half-segments adapted for assembly with each other to define said flow path, at least one of said half-segments having said heat transfer surface formed thereon.

10. The turbine blade of claim 9 when both of said half-segments have said heat transfer surface formed thereon.

11. The turbine blade of claim 5 wherein said turbulator vanes extend generally transversely to the direction of flow of the cooling gas stream through said flow path.

* * * * *